US006613195B2

(12) United States Patent
Anderson

(10) Patent No.: US 6,613,195 B2
(45) Date of Patent: Sep. 2, 2003

(54) METHOD FOR CONDITIONING PAPER AND PAPERBOARD WEBS

(75) Inventor: Dennis W. Anderson, Middletown, NY (US)

(73) Assignee: International Paper Company, Purchase, NY (US)

( * ) Notice: Subject to any disclaimer, the term of this patent is extended or adjusted under 35 U.S.C. 154(b) by 0 days.

(21) Appl. No.: 10/191,747

(22) Filed: Jul. 9, 2002

(65) Prior Publication Data

US 2003/0000673 A1 Jan. 2, 2003

Related U.S. Application Data

(60) Continuation of application No. 09/789,100, filed on Feb. 20, 2001, now abandoned, which is a division of application No. 09/076,192, filed on May 12, 1998, now Pat. No. 6,207,020.

(51) Int. Cl.[7] ..... D21G 9/00; B05B 1/00; B05B 1/26; B05B 3/02

(52) U.S. Cl. ..... 162/289; 239/518; 239/524; 239/222.11; 239/222.13; 239/270; 239/271; 239/358; 34/114

(58) Field of Search ..... 162/272, 263, 162/275, 289; 34/114–122, 218, 221, 224; 239/518, 524, 88, 95–96, 103, 115, 222.11, 222.15, 270, 271, 294, 358, 476, 550–555; 137/438; 261/DIG. 39; 226/91, 7, 97.3

(56) References Cited

U.S. PATENT DOCUMENTS

| | | | | | |
|---|---|---|---|---|---|
| 992,688 | A | * | 5/1911 | Pope | 34/117 |
| 3,635,407 | A | * | 1/1972 | Wheelock | 239/514 |
| 3,714,720 | A | | 2/1973 | Drost et al. | |
| 3,838,000 | A | | 9/1974 | Urbas | |
| 4,207,143 | A | | 6/1980 | Glomb et al. | |
| 4,253,247 | A | | 3/1981 | Bergstrom | |
| 4,274,210 | A | | 6/1981 | Stengard | |
| 4,321,760 | A | | 3/1982 | Meier | |
| 4,689,895 | A | | 9/1987 | Taylor et al. | |
| 4,738,197 | A | | 4/1988 | Malkia | |
| 4,763,424 | A | | 8/1988 | Taylor et al. | |
| 4,785,985 | A | | 11/1988 | Hurtgen | |
| 4,836,894 | A | | 6/1989 | Chance et al. | |
| 4,889,146 | A | | 12/1989 | Beal | |
| 5,038,495 | A | | 8/1991 | Jacobs et al. | |
| 5,331,749 | A | | 7/1994 | Thiele | |
| 5,440,821 | A | | 8/1995 | Hamrin | |
| 5,470,436 | A | | 11/1995 | Wagle et al. | |
| 5,471,847 | A | | 12/1995 | Murray et al. | |
| 5,524,532 | A | | 6/1996 | Koivukunnas et al. | |
| 5,535,527 | A | * | 7/1996 | Virta et al. | 34/117 |
| 5,553,394 | A | | 9/1996 | Cosley | |
| 5,661,911 | A | * | 9/1997 | Yli-Kauppila | 34/117 |
| 5,778,559 | A | | 7/1998 | Winheim | |
| 5,884,415 | A | | 3/1999 | Sims et al. | |
| 6,142,391 | A | | 11/2000 | Seyed-Yagoobi et al. | |
| 6,145,759 | A | | 11/2000 | Susa | |
| 6,207,020 | B1 | | 3/2001 | Anderson | |

* cited by examiner

*Primary Examiner*—Jose A. Fortuna
(74) *Attorney, Agent, or Firm*—Luedeka, Neely & Graham, P.C.

(57) ABSTRACT

The specification discloses embodiments of a process and related apparatus for conditioning a fibrous web in order to improve the efficiency of drying and calendering thereof. In the process, a moving fibrous web is conditioned after the drier unit of a papermaking machine by applying a flow of moistened gas through one or more arrays of radial jet reattachment nozzles placed in close proximity to the web surface prior to a calendering unit or prior to a steaming unit placed between the nozzles and the calender unit to cool the web and/or increase its moisture content. Webs treated according to the invention exhibit improved properties including less moisture streaking, enhanced smoothness and avoidance of optical property loss.

6 Claims, 6 Drawing Sheets

METHOD FOR CONDITIONING PAPER AND PAPERBOARD WEBS

This application is a continuation of application Ser. No. 09/789,100 filed Feb. 20, 2001, now abandoned, which in turn is a divisional of application of Ser. No. 09/076,192 filed May 12, 1998, which issued Mar. 27, 2001 as U.S. Pat. No. 6,207,020.

FIELD OF THE INVENTION

The invention relates to the art of papermaking, and particularly to a method for conditioning fibrous webs such as paper and paperboard webs on a papermaking machine after the web is dried to improve the properties of the web.

BACKGROUND

The conventional process of papermaking involves formation of a web of fibers on a papermaking machine using a moving porous foraminous support wherein water is drained from a dilute slurry of fibers deposited on the support with further water removal from the web in a press roll section and final removal of water in a dryer section of the machine. In a typical papermaking process, the fibrous web from the press roll section contains about 32 to 45 wt. % solids. The solids may include wood pulp and/or synthetic fibers along with various additives such as sizing agents, binders, fillers, pigments and the like. The wet web is then passed through a series of internally heated rolls or steam-filled cylinders in the dryer section where the web is dried to about 94% to about 99% solids content by weight. The number of drying cylinders in the dryer section is determined by the amount of water to be evaporated based on a typical evaporation rate of about 3 to about 5 pounds per hour per square foot of total dryer surface.

In the dryer section of the paper machine, water is removed from the web mainly by evaporation. Typically, the wet web is alternately contacted on its opposite sides in serpentine fashion with a series of heated co-rotating cylinders to heat the web to a temperature sufficient to evaporate water from the web to the desired dryness.

Once dried, the paper or paperboard is often further treated to improve various properties such as smoothness, gloss, wet strength and folding endurance. This further treatment may include adjusting the moisture content of the dried-web, densification on high pressure rolls, calendering and/or heat-treating the product.

Various problems have persisted in the drying and calendering of paper webs on large, high-capacity paper machines. For example, drying and calendering of the products remains a high energy, capital intensive operation. Hence, the industry is challenged to develop newer and more energy efficient drying and calendering techniques. Such techniques include high-intensity drying methods where high temperatures and mechanical pressure is applied to the web during drying. Examples of currently used high-intensity drying techniques include press drying, impulse drying, and thermal/vacuum drying. However, the use of high temperature dryers and/or impulse dryers has led to additional problems such as delamination of multiply board products.

Furthermore, in the presently used drying and calendering processes, the paper may shrink in width by as much as 5 to 6% which can lead to a significant reduction in the overall production rate, and adversely affect product quality.

Accordingly, even with modern, state-of-the-art drying and calendering techniques, there remains a need to further improve the drying and calendering of paper and paperboard products to reduce energy costs and limit paper shrinkage without adversely affecting the physical properties of the finished product.

Uneven drying and streaking are other problems which have persisted in production of paper and paperboard webs. The weight and moisture irregularity of the fiber web before drying and calendering, irregularities in the heat transfer from the cylinders, edge effects and variations in the ventilation of the papermaking machine all tend to cause nonuniform drying in the cross-machine direction of the product. Such nonuniformity of drying can lead to further adverse effects on paper quality and increased waste.

U.S. Pat. No. 4,378,639 to Walker and U.S. Pat. No. 4,474,643 to Lindblad propose a solution to the problem of uneven drying across the width of the web by periodically spraying water on the web in selected areas across width of the web where low moisture or dry streaks have been detected. Because the water sprays are intermittent and used only when necessary to prevent streaks, such techniques do not effectively increase the drying rate of the web and can introduce nonuniformity in the web surface properties. These and other such approaches also present problems in that the spray nozzles can drip onto the web or otherwise tend to wet the paper in spots or unevenly, resulting in poor efficiency and surface discontinuities in the rewetting, drying and calendering steps, as well as other operational problems.

It is therefore an object of the invention is to improve the efficiency, uniformity and product quality of drying and/or calendering steps in a papermaking process.

A further object of the invention is to provide a more effective method for conditioning paper and paperboard products prior to rewetting the products.

Yet another object of the invention is to increase the drying efficiency of a papermaking process.

Another object of the invention is to provide a method for conditioning a paper or paperboard product for calendering which reduces operational problems associated with prior methods, and improves surface finishing.

Another object of the invention is to provide an efficient means of cross-directional moisture profiling of a paper or paperboard product on a papermaking machine.

SUMMARY OF THE INVENTION

With regard to the foregoing and other objects, the present invention provides, in accordance with its more general aspects, a method for treating an elongate moving web which comprises conditioning the web by applying a flow of moistened gas to a surface of the moving web across its width and along at least a portion of its length from a plurality of substantially overlapping flow zones wherein the flow in each zone is sufficient to create a combination of suction and pressure forces on the surface of the web to promote convective heat transfer and thereby decrease its surface temperature.

As used herein, "moistened gas" means a carrier or motive gas, such as air, which has an absolute humidity of 0.01 or higher. The state of the water in the moistened gas may be vapor, or more preferably primarily liquid in the form of a relatively fine dispersion of small droplets such as a mist combined with evaporated water in the form of gas. As will be described in greater detail hereinafter, it is a feature of the invention that the water droplets are, by virtue of the flow regime used to deliver the moistened gas, propelled against the surface of the web so as to make contact therewith in a relatively even and highly dispersed manner to thereby achieve uniform and rapid cooling and moisturizing of the web.

In one embodiment, the method comprises treating a fibrous web proceeding from a dryer unit of a papermaking machine, the web having a moisture content below about 8 wt. % and a temperature of at least about 80° C., which comprises conditioning the web by applying a flow of moistened gas having a temperature in the range of from about 10° to about 65° C. to a surface of the moving web across its width and along at least a portion of its length from a plurality of substantially overlapping flow zones wherein the flow is sufficient to create a combination of suction and pressure forces on the surface of the web to enhance convective heat transfer and thereby decrease its temperature. Depending on the amount of water applied to the web via the moistened gas, the conditioning may, in addition to decreasing the temperature of the web, increase the moisture content of the web. After the conditioning treatment, the web may be further treated in a process such as calendering, coating and the like. If desired, the web surface, after conditioning may be further moistened using a steaming device.

In a preferred embodiment, moistened gas is applied to the web in the aforementioned manner of overlapping flow zones using one or more arrays of radial jet reattachment nozzles. The nozzles are configured and spaced relative to each other and to the surface of the web to cause the moistened gas to be delivered relatively evenly across the web surface in flow patterns which create a combination of suction and pressure forces on the web. This enables the desired rapid surface cooling and moisturizing effect on the web as it proceeds from the dryer unit to any subsequent steaming and/or calendering steps.

In another aspect, the invention provides a papermaking process which comprises depositing an aqueous slurry of cellulosic and/or synthetic fibers at a consistency of from about 0.2 to about 1.5% by weight on a moving web former screen thereby forming a layer of slurry on the screen. The slurry is dewatered on the moving screen to form a fibrous web which is passed from the screen and then pressed with one or more wet press nips to provide a pressed web having a solids content in the range of from about 32 to about 45% by weight. The pressed web is then dried such as on a series of drying cylinders or other suitable drying equipment to provide a dried web having a moisture content of from about 0.2 to about 6% by weight. Thereafter, the dried web is conditioned by applying a flow of moistened gas to the web surface using a plurality of radial jet reattachment nozzles placed in close proximity to the web on one or both sides of the web to provide a conditioned web having a moisture content which is substantially uniformly increased across its width by at least about 0.2% relative to the moisture content prior to conditioning. The conditioned web may then be further rewet, if desired, by steaming or other means, and subsequently smoothed in a calendering unit or such operation. Alternatively, the conditioned web may be coated, which conditioning provides improved coating holdout.

One advantage of treating a web on a papermaking machine according to the invention is that the web may be uniformly and efficiently moisturized and cooled substantially below the temperature of the dried web proceeding from the dryer unit, preferably reducing the surface temperature to less than about 80° C. using an even application of moistened gas so that any subsequent rewetting of the web occurs in the absence of deleterious effects associated with rewetting higher temperature product before calendering. For example, adverse effects on the cross directional shrinkage of the paper or paperboard product may be limited and desired density, tensile strength compression and caliper in the cross machine direction of the finished product may be achieved more readily and consistently with improved control over these and other properties of the finished product.

Another advantage of conditioning a web according to the invention in the papermaking context is that the resulting web thickness and stiffness after calendering to a desired smoothness may be improved as compared to webs conditioned using conventional techniques. Accordingly, the paperboard product can be made with increased bulk for a given basis weight and a product having a reduced basis weight will still meet caliper specifications. The more efficient surface cooling and moisturizing of the web obtained by use of the invention also enables increased spring back properties during calendering since the moisture is retained by the surface fibers of the web more efficiently than with other moisturizing techniques.

In some applications, it may be desirable to cool the web surface without significantly increasing the moisture content of the web. To this end, it will be appreciated that the invention may be practiced to cause emanation of a mist of minute water droplets from an array of radial jet reattachment nozzles wherein the water droplets have sufficient momentum to penetrate the boundary layer of hot, dry air attached to the moving web so that they impact the web surface. The moisture impacting the web surface rapidly cools the surface by acting as both a latent and a sensible heat sink. The applied surface moisture flashes to vapor upon contact with the hot web, thereby cooling the web. By use of an appropriate amount of moisture in the gas, the web surface is cooled without significantly increasing the moisture content of the web. Very high shear rates are attainable using the reattachment nozzles in a reattachment zone of the nozzle flow pattern which provides high convective heat transfer and high mass transfer coefficients to effectively "scrub" the web surface resulting in more efficient heat transfer from the web surface.

In applications requiring both cooling and moisturizing, higher mist loadings may be applied to the web surface with the reattachment nozzles resulting in substantial retention of moisture on the web surface. Hence, the web is both cooled and moisturized. This limits or avoids entirely the need to apply moisture to the web using conventional water spray nozzles or other means. If additional surface moisture application is desired, existing methods of applying surface moisture become more effective because of the cooling effects provided by this invention. Furthermore, the reattachment nozzles have fewer moving parts than water spray nozzles thereby reducing the maintenance costs associated with cooling and/or moisturizing a web.

BRIEF DESCRIPTION OF THE DRAWINGS

The above and other features and advantages of the invention will now be further described in the following detailed description of preferred embodiments of the invention considered in conjunction with the drawings in which.

DETAILED DESCRIPTION OF THE INVENTION

Figure 1:
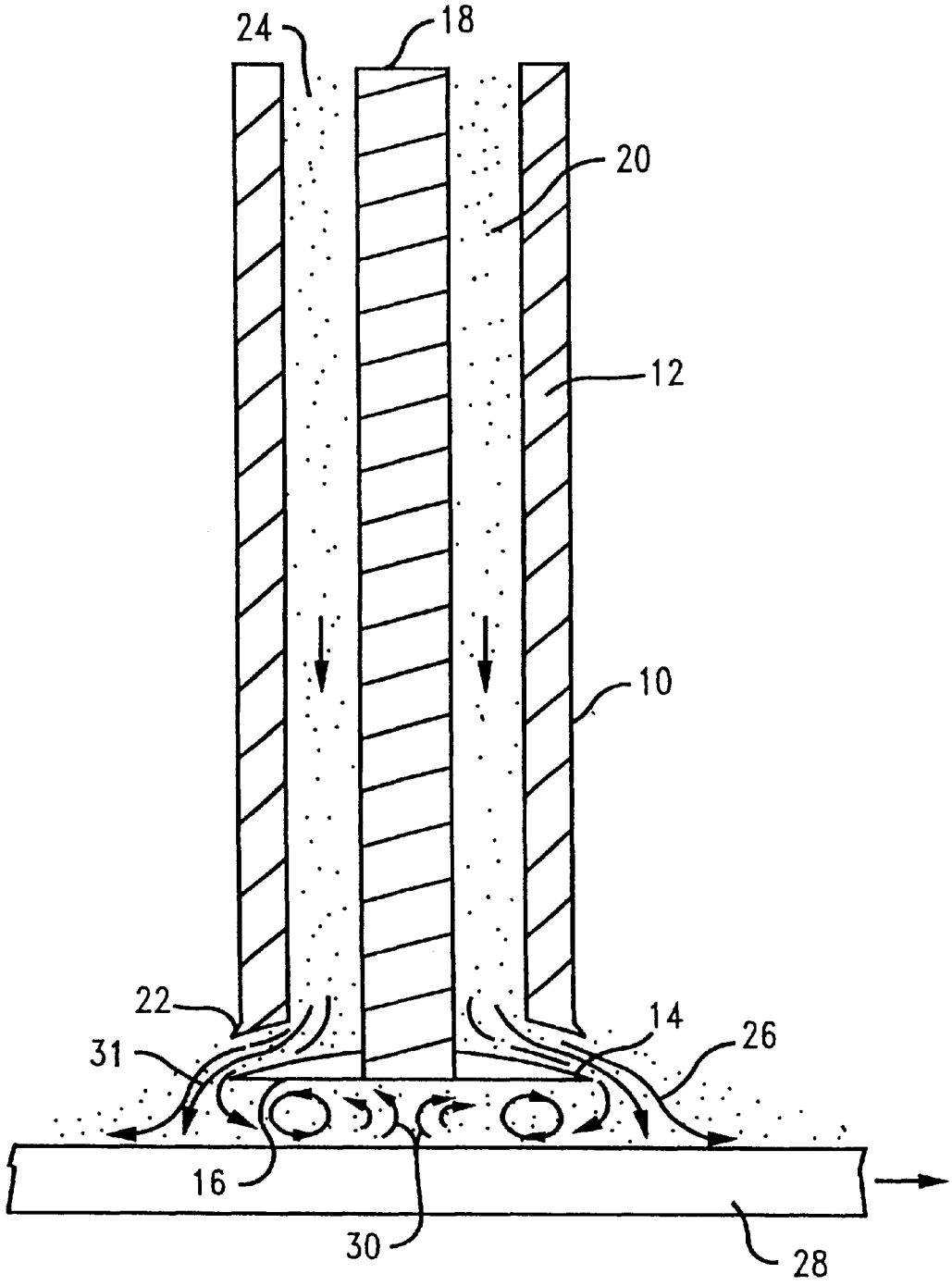
FIG. 1 is an elevational view of a radial jet reattachment nozzle for use in conditioning a paper or paperboard web according to one embodiment the invention.

Referring now to the drawings wherein like reference characters designate like or similar parts throughout the several views, features of various radial jet reattachment nozzles 10 for use in practicing the invention will now be described. With initial reference to FIG. 1, a preferred nozzle 10 comprises an elongate cylindrical sleeve 12 and flow director 14 which includes an outwardly flared, trumpet-shaped head 16 supported on an elongate cylindrical rod 18. The rod 18 is coaxially centered in sleeve 12 to provide an annular flow space 20 between sleeve 12 and rod 18. The head 16 extends out of circular open end 22 of sleeve 12 and, at its widest point or base, has a slightly greater diameter than that of sleeve 12.

As will be hereinafter described in greater detail, sleeve 12 and flow director 14 of nozzle 10 may be supported on a plenum or manifold (see FIG. 7) along with a plurality of other like nozzles to provide an array of nozzles for conditioning web 28 across its width as the web moves past the array of nozzles.

Moistened gas 24, preferably air containing a fine water mist, is directed along annular space 20 between sleeve 12 and rod 18 so that it exits the nozzle 10 through sleeve open end 22. Moisture may be added to the gas by a variety of atomization techniques well known to those of ordinary skill.

At the prevailing gas velocities in the annular space 20, the shear rate provided by the flowing gas stream will be sufficient to break liquid contained in the air stream into fine droplets, resulting in a turbulent mist emanating radially outwardly from the nozzle 10 as indicated by arrows 26. The shape of head 16 in conjunction with its spacing, dimension and arrangement relative to open end 22 of sleeve 12 creates a turbulent flow regime which has the effect of causing flows of gas both toward the web surface 28 as indicated by flow arrows 31 and away from the surface of the adjacent web 28 as indicated by flow arrows 30 near the center of the nozzle 10, while providing a cushion of gas which limits contact between the web 28 and the head 16 with a minimum of fluttering or other undesired movement of the web 28 in a direction normal to its surface.

The relative positions of flow director 14 and sleeve 12 may be fixed, or they may be adjustable relative to one another. It is preferred that the position of flow director 14 be adjustable relative to the sleeve 12 by axial movement of rod 18 within sleeve 12 so that the distance between the head 16 and open end 22 of sleeve 12 may be increased or decreased. By adjustment of the position of the flow director 14 in this fashion, the velocity and/or flow rate of moistened gas impinging on web 28 can be varied as well as the flow pattern. In an alternative design, flow director 14 may be fixed and sleeve 12 may be supported for axial movement relative to head 16 so that the distance between the head 16 and open end 22 may be increased or decreased.

It will be appreciated that both sleeve 12 and flow director 14 may be also supported for movement as a unit in a direction normal to the surface of web 28, whereby the spacing between head 16 and open end 22 of sleeve 12 may be adjusted as well as the spacing of head 16 from the surface of web 28. Combinations of adjustments in the positions of sleeve 12 and flow director 14 therefore may be employed to adjust the mass flow rate and/or velocity of moistened gas impinging on the web 28, the pattern of flow onto and across the web and the spacing between head 16 and the surface of the web.

A combination of appropriate nozzle design and adjustment of the distance between the head 16 and sleeve opening 22 will provide a nozzle 10 having a wide range of operating conditions. By way of example, and not for purposes of limitation, sleeve 12 may have an inside diameter of from about 25 to about 75 millimeters and an outside diameter of from about 26 to about 80 millimeters, and rod 18 may have a diameter of about 4 to about 5 millimeters so that annular space 20 has a radial dimension of about 10 to about 35 millimeters. Head 16 may have a diameter at its widest point within ±10 percent of the outside diameter of sleeve 12. In this example, the separation space between head 16 and sleeve opening 22 may be varied between operation limits of from about 2 to about 7 millimeters.

Suitable radial jet reattachment nozzles 10 and associated structure for use in practicing the invention are described in U.S. Pat. No. 4,274,210 to Stengard and U.S. Pat. No. 5,331,749 to Thiele, the disclosures of which are incorporated herein by reference as if fully set forth.

Figure 2:
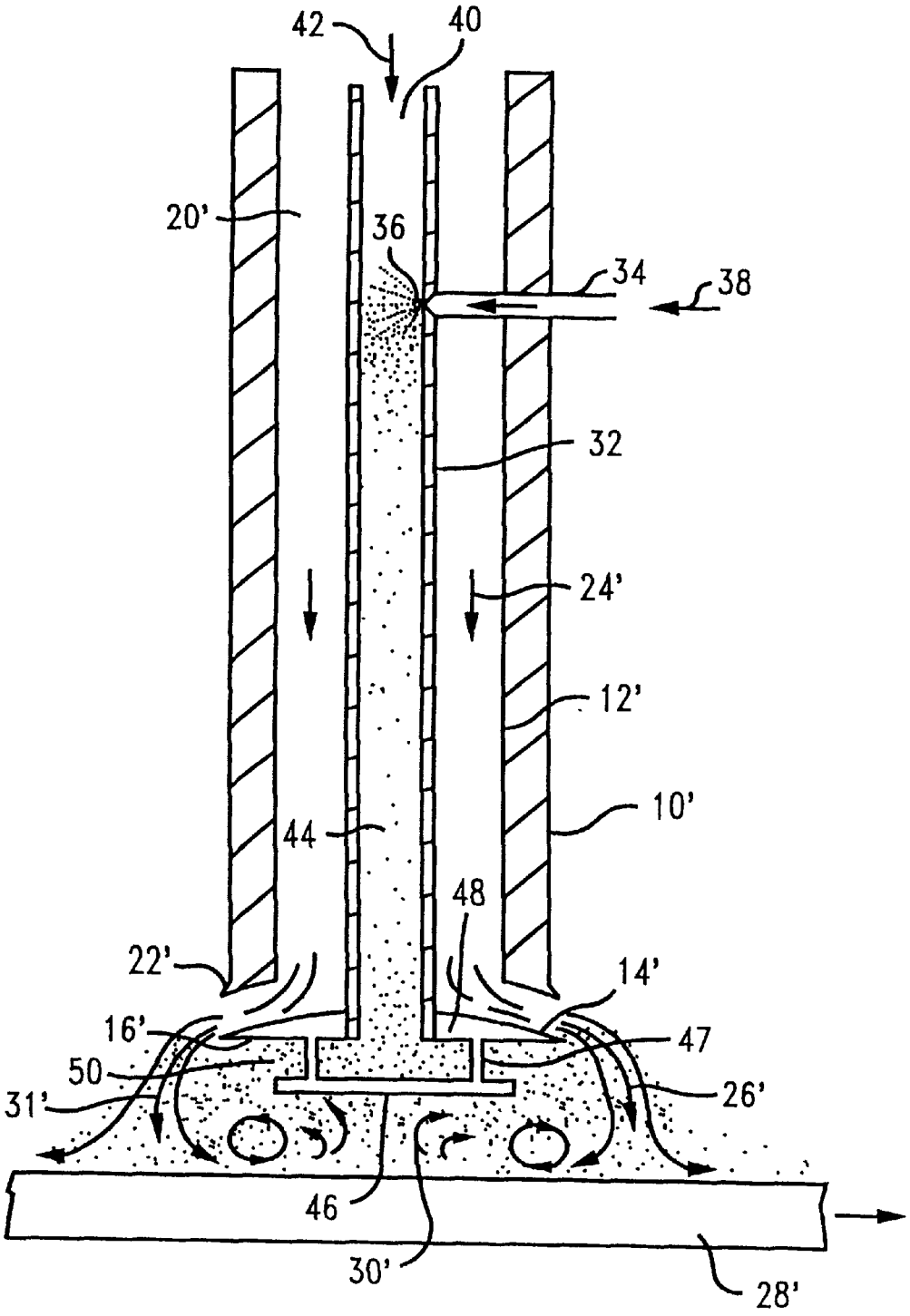
FIG. 2 is an elevational view of an alternative design of a radial jet reattachment nozzle for use in conditioning a paper or paperboard web according to another aspect of the invention.

An alternative nozzle design is illustrated in FIG. 2 wherein the nozzle 10' comprises an elongate cylindrical sleeve 12' and a flow director 14', the latter of which includes an elongate cylindrical tube 32 coaxially centered in sleeve 12' to provide an annular flow space 20' between sleeve 12' and tube 32. As with rod 18 shown in FIG. 1, tube 32 may have an outside diameter ranging from about 4 to about 5 millimeters.

A liquid inlet ejector 34 having an orifice 36 is provided for introducing a liquid 38 such as water in the form of a spray into the interior 40 of the tube 32. A gas 42 such as air introduced into the interior 40 of the tube 32 entrains the spray so that moistened gas 44 containing a fine mist of liquid entrained droplets is produced.

A high velocity flow of gas 24', which may also be moistened, is directed along the annular space 20' between sleeve 12' and the outside surface of tube 32 so that it exits the nozzle 10' through sleeve open end 22'. The resulting flow of gas as indicated by arrows 26' exiting the nozzle 10' is induced by the shape of head 16' in conjunction with its spacing, dimension and arrangement relative to open end 22' of sleeve 12' to a turbulent flow regime which has the effect of causing flows of gas both toward the web surface 28' as indicated by flow arrows 31' and away from the surface of a web 28' as indicated by flow arrows 30' adjacent the center of the nozzle 10', while providing a cushion of gas which limits contact between the web 28 and the head 16' with a minimum of fluttering or other undesired movement of the web 28' in a direction normal to its surface. In this embodiment, head 16' is circular and has a dome shape on its upper surface as shown.

A circular deflector plate 46 is attached by means of a plurality of circumferentially spaced-apart rods 47, preferably at least three, in depending relation to the head 16' spaced from the open end 48 of tube 32 to provide a gap 50 between the open end 48 and the plate 46. The gap preferably ranges from about 4 to about 12 millimeters and provides a means for inducing entrainment of the moistened gas 44 from the tube 32 into the turbulent gas flow 26' exiting the nozzle 10'. It is preferred that the diameter of plate 46 be somewhat less than that of head 16' and be centered in relation thereto. A preferred diameter of plate 46 is about equal to that of the inner diameter of the tube 12.

Figure 3:
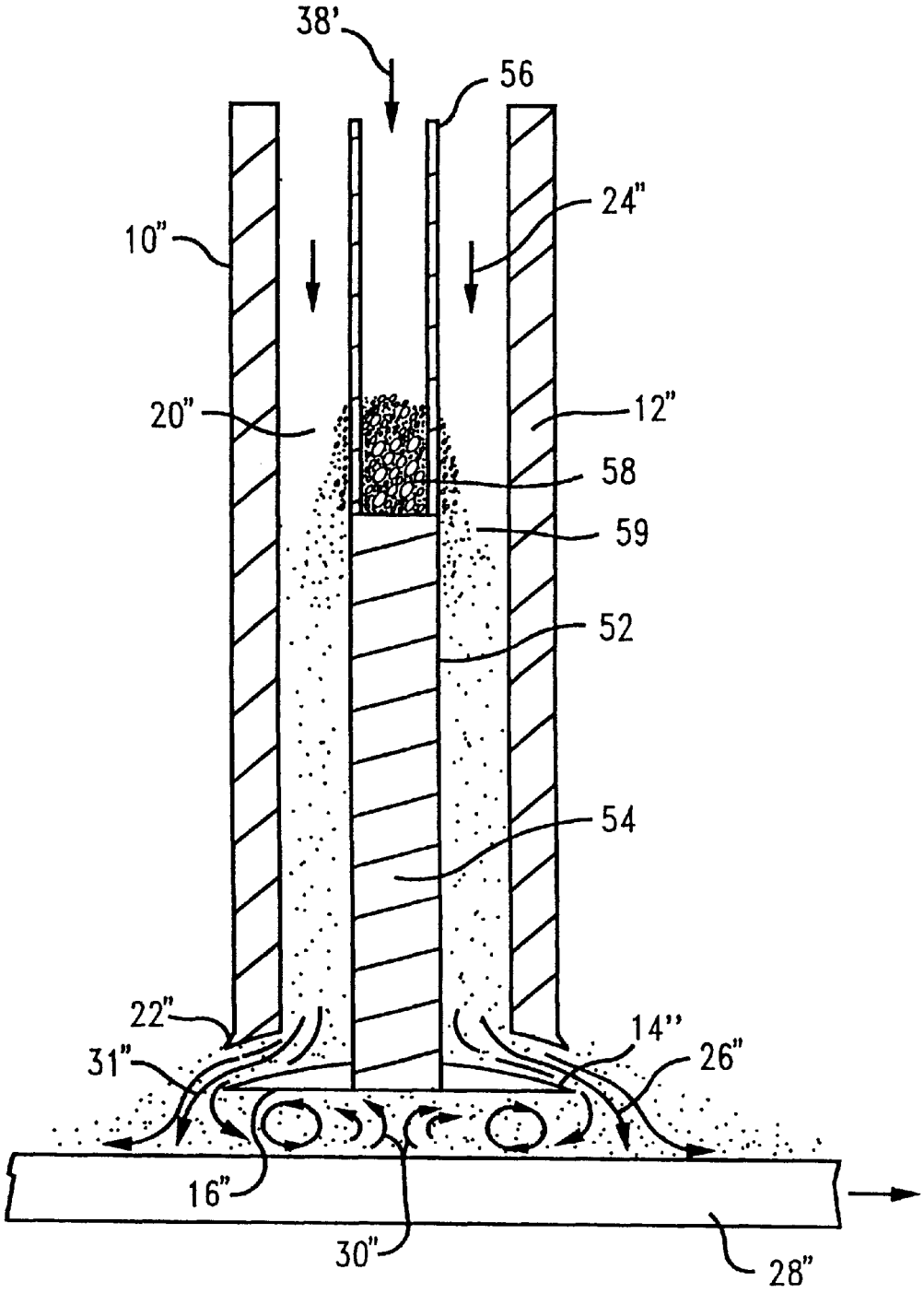
FIG. 3 is yet another elevational view of an alternative design of a radial jet reattachment nozzle for use in conditioning a paper or paperboard web according to still another aspect of the invention.

FIG. 3 illustrates a further alternative embodiment wherein nozzle 10" comprises an elongate cylindrical sleeve 12" and a flow director 14" which includes an elongate cylindrical rod 52 having a distal solid or otherwise flow-blocked section 54, a proximal solid-walled tubular section 56 and a porous section 58 disposed between tubular section 56 and solid section 54. The porous section 58 may be provided by sintered metal or by a perforated, or slotted tube filled with a granular material such as sand, gravel or other inert particulate material. Porous section 58 is preferably at least about 25 millimeters long.

A flow of liquid 38' such as water is directed into the tubular section 56 of the elongate rod 52. The liquid weeps or otherwise passes out of section 58 in a manner sufficient to form small droplets 59 which are entrained in a flow of gas 24" directed along the annular space 20" between the sleeve 12" and the elongate rod 52.

As with the previously described embodiments, gas 24" flowing into space 20" may be dry gas or may be moistened gas which is additionally moistened and entrains a fine mist of liquid droplets as it flows along the annular space 20" between the inner surface of sleeve 12" and the outside surface of the rod 52. The moistened gas exits the nozzle 10" through sleeve open end 22". Head 16" in this embodiment preferably has a shape, dimension and spacing relative to sleeve 12" and its open end 22" corresponding substantially to that of head 16 of FIG. 1.

The resulting flow of moistened gas exiting the nozzle 10" is induced by the shape of head 16" in conjunction with its spacing, dimension and arrangement relative to open end 22" of sleeve 12" to a turbulent flow regime as indicated by arrows 26" which has the effect of causing flows of gas both toward the web surface 28" as indicated by flow arrows 31" and away from the surface of a web 28" as indicated by flow arrows 30" adjacent the center of the nozzle 10", while providing a cushion of gas which limits contact between the web 28" and the head 16" with a minimum of fluttering or other undesired movement of the web 28" in a direction normal to its surface.

Figure 4:
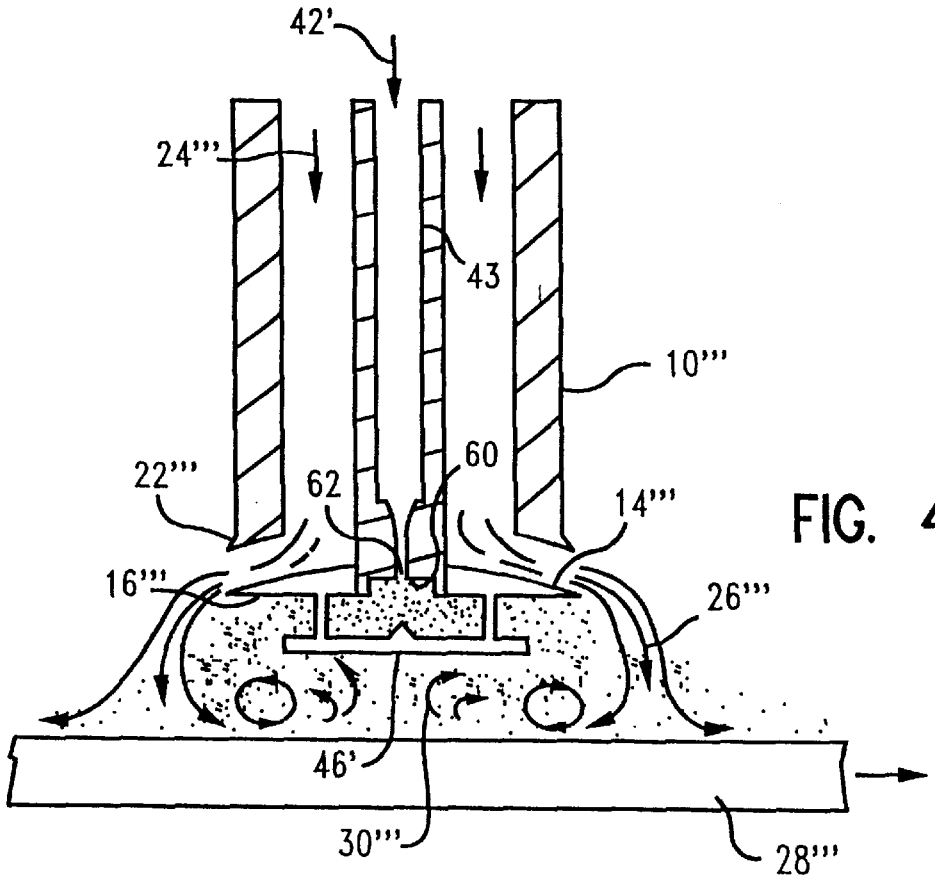
FIG. 4 is another elevational view of an alternative design of a radial jet reattachment nozzle for use in conditioning a paper or paperboard web according to yet another aspect of the invention.
Figure 5:
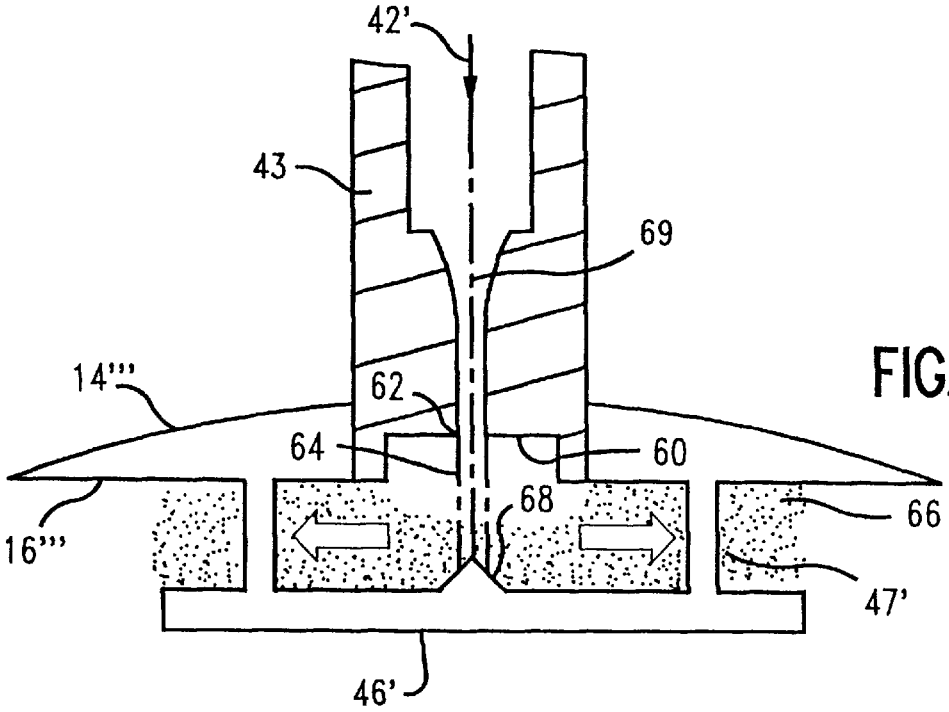
FIG. 5 is a cross-sectional view of a portion of the radial jet reattachment nozzle of FIG. 4.

FIGS. 4 and 5 illustrate features of a further alternative design of a nozzle 10'" for use in practicing the invention wherein liquid 42' such as water is directed through elongate tube 43 of flow director 14'" which supports head 16'" at the distal end 60 thereof. The terminal end 60 of the tube 43 contains an orifice 62 in the form of a circular opening which may range from about 0.006 to about 0.018 inches in diameter. Orifice 62 is configured to produce a fine stream or spray of high pressure liquid 64 which is directed against deflector plate 46' attached to head 16'" by means of a plurality of circumferentially spaced apart rods 47', preferably at least three, thereby producing a fine mist of liquid droplets 66 which is entrained in the moistened gas exiting the nozzle 10'" between the head 16'" and plate 46' as shown by arrows 26'".

Deflector plate 46' is preferably a circular disc as shown in FIG. 2 and preferably contains a circular, cone-shaped upwardly projecting portion 68 for improved formation of fine liquid droplets resulting from the impact of the liquid on deflector plate 46' and to promote radially outward flow into a turbulent flow regime and the inwardly swirling flow pattern as shown by arrows 30'". The sloped side walls of portion 68 form included angles with respect to the planar surface of plate 46' of about 45°. The apex of portion 68 is preferably axially aligned with orifice 62 and spaced therefrom a distance of from about 4 to about 12 millimeters. Head 16'" preferably has a configuration and is dimensioned corresponding substantially to that of heads 16' and 16" of FIGS. 2 and 3, respectively, as well as a corresponding adjustable separation distance from sleeve opening 22'". Plate 46' is also preferably dimensioned and spaced from head 16'" in substantially the same manner as plate 46 of FIG. 2. In an alternative embodiment, portion 68 is dome shaped rather than conical to aid in droplet generation and distribution.

As with the embodiments of FIGS. 1–3, the flow of moistened gas as indicated by arrows 26'" and 30'" provided by nozzle 10'" of FIGS. 4–5 causes flows of moistened gas both toward and away from the adjacent surface of moving web 28'", while providing a cushion effect which limits contact between web 28'" and head 16'" with a minimizing of fluttering or other undesired movement of web 28'" in a direction normal to its surface facing head 16'". All the while, by virtue of the relatively high velocity flow produced by the various nozzle designs described herein and the swirling turbulent flow regime, the moistened gas effectively "scrubs" away the flow boundary of relatively high temperature air adjacent the surface of the web enabling water droplets in the moistened gas to be carried into contact with the web surface, whereby rapid evaporative cooling and moisturizing of the web may be achieved.

As long as sufficient turbulent air flow is maintained for the moistened gas exiting the nozzles, they do not need to be heated to avoid condensation of the mist on the nozzle surfaces. However, if desired, a heating system may be used to maintain the nozzle temperature above the dew point of the moisturized gas.

The nozzles described herein may be made from a variety of materials appropriate for use in the environment of a papermaking machine. Suitable materials include non-oxidizing or corrosion resistant metals such as stainless steel, nickel, titanium, alloys of iron and nickel, alloys of titanium and aluminum and the like. Other materials may be used provided they are resistant to moisture, stable under high temperature conditions and resilient enough to withstand thermal and mechanical shock such as may occur as a result of a paper web break during production as well as periodic adjustment or maintenance.

In contrast to conventional air nozzles, the nozzles used in practicing the present invention provide a highly effective turbulent gas flow adjacent the surface of the web which creates a negative force on the web urging the web toward the nozzle rather than away from the nozzle which is determined to be particularly effective in application of moistened gas to the web. In particular, the gas flow rate and ejection angle of the moistened gas exiting the nozzle induces unusual eddy currents creating areas of reduced pressure between the nozzle and the surface of web urging the web toward the nozzle. However, the flow of moistened gas between the nozzle and the web effectively prevents contact between the web and the nozzle.

As the web is urged toward the nozzle, moist gas flowing from the nozzle contacts the web radially in substantially all directions. Such gas flow rapidly lowers the surface temperature of the web and, in certain embodiments, increases the moisture content of the web. Some or all of the added surface moisture may flash from the web surface, depending on the web temperature, the weight of the web and the moisture loading of the gas, thereby cooling the web and in some cases increasing its moisture content to within a desired range.

Figure 6:
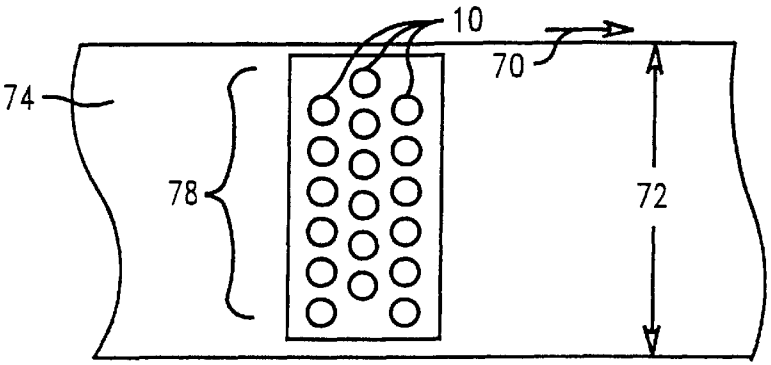
FIG. 6 is a plan view diagrammatically illustrating the use of an array of radial jet reattachment nozzles adjacent the surface of a moving web of paper.

In the practice of the invention, a plurality of nozzles are used and are arranged in spaced apart fashion in an array spread across the width and along a portion of the length of the web supported in close proximity to the surface of the web, preferably on both sides of the web. The actual number and arrangement of nozzles across the width of the web will be determined on a case-by-case basis depending on factors such as the paper basis weight and width, machine speed and the like. In order to achieve optimum web conditioning with the fewest nozzles, the nozzles are preferably arranged in a staggered pattern as illustrated in FIG. 6 so that adjacent rows of nozzles are offset from each other both in the cross machine direction and in the direction of web movement as shown by arrow 70. Many other nozzle arrangements may be used provided the number and arrangement of nozzles is sufficient to effectively condition the web across its width 72. The inlet end of each nozzle is preferably connected to an inlet gas plenum for providing a high velocity gas stream to the nozzles.

By reason of the arrangement shown in FIG. 6 employing one or more arrays of nozzles according to the various embodiments thereof (FIGS. 1–5), moistened cooling gas is caused to flow against the web 74 simultaneously from a plurality of spaced-apart locations across the width 72 and along a portion of the length of the web as it moves past the nozzle arrays. The gas flow creates a plurality of overlapping zones of influence on the web 74 characterized by a combination of vacuum or suction forces as well as pressure forces on the web surface which, along with the turbulence and eddy currents created thereby, penetrates, strips away or significantly disturbs the boundary layer adjacent the web surface for enhanced heat and mass transfer. Furthermore, small water droplets in a fine water mist delivered through nozzles have sufficient momentum to penetrate the boundary layer of hot dry air carried along the web surface from a dryer unit so that a significant portion thereof can readily reach and be absorbed by the web surface. The result is a highly efficient, uniform and rapid moisturizing and cooling effect on the web across its width even at relatively high machine speeds in the order of about 1200 to about 1500 meters per minute.

Figure 7:
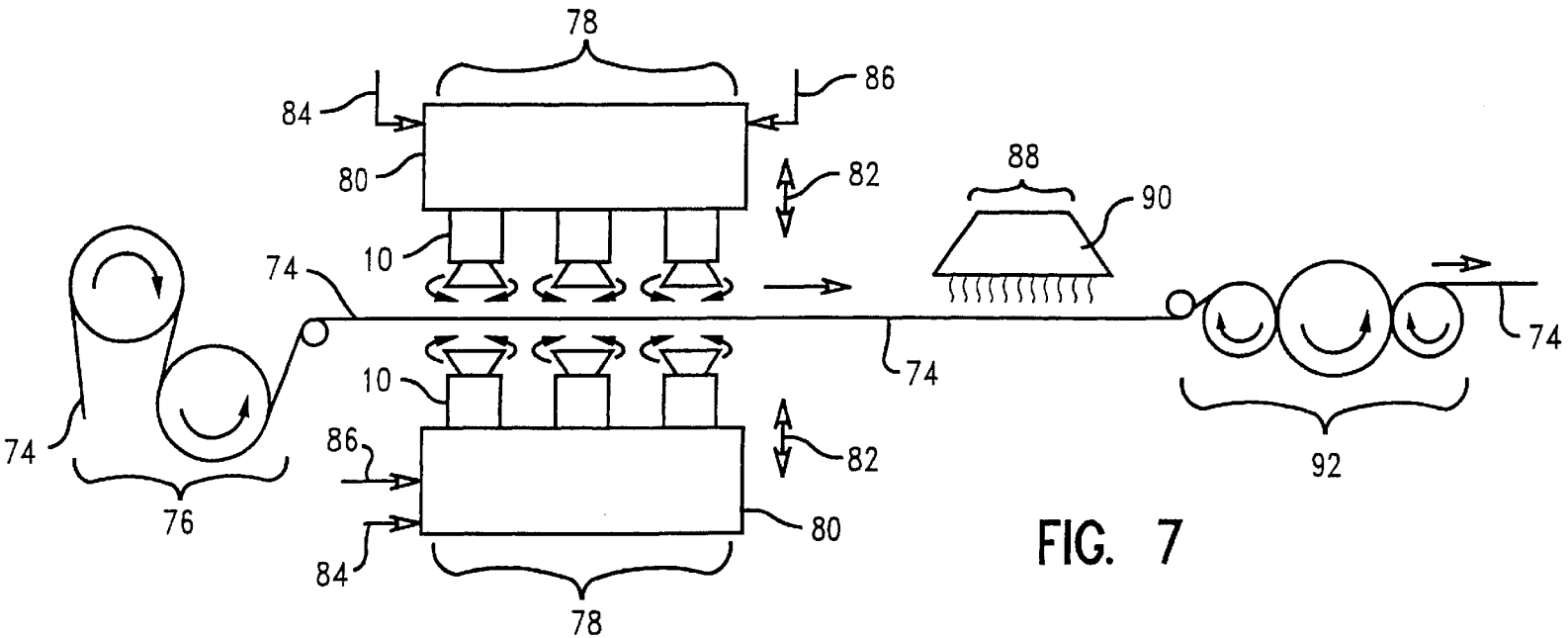
FIG. 7 is a diagrammatic view illustrating steps in a web conditioning process using radial jet reattachment nozzles for conditioning a moving web of paper according to one embodiment of the invention.

Referring now to FIG. 7 in conjunction with FIG. 6, a preferred sequence of steps according to the invention for conditioning a paper web 74 on a papermaking machine is illustrated. In this embodiment, nozzles according to the nozzle design 10 of FIG. 1 are illustrated in use, but it is understood that the nozzle designs of FIGS. 2–5 as well as other functionally equivalent designs may be used.

As shown in FIG. 7, web 74 proceeding from the wet press section (not shown) is conducted in a conventional fashion through any of several papermaking unit processes and ultimately through a dryer unit 76 comprising a plurality of internally heated dryer cylinders (illustrated diagrammatically as two cylinders, for sake of simplicity) where its moisture content is decreased to about 0.2 to about 6% by weight. Web 74 proceeds from dryer unit 76 at a temperature which may range from about 80° to about 170° C. past one or more arrays 78 of nozzles 10 arranged as shown in FIG. 6 above and below the web 74 to condition the web in the aforedescribed manner, lowering its surface temperature in this embodiment by at least about 20° C. and increasing the web moisture content to at least from about 0.2 to about 1.0 percent over the moisture content of the web emerging from dryer unit 76. However, it will be appreciated that by adjustment of the nozzle configuration and their spacing relative to the surface of the web, as well as the water loading of the moisturized gas, the invention may be practiced so that there is essentially little or no increase in the moisture content of the web while its temperature is nevertheless decreased substantially in a relatively short length of time. It will also be appreciated that the invention may be practiced by treating only one surface of the web, depending on manufacturing and product requirements.

It is preferred to place the nozzle arrays 78 in the production line outside of the dryer unit 76, which is typically an enclosed or hooded structure containing a series of stacks of rotating cylinders. Because the nozzles 10 are not located in the dryer unit 76, fewer operational problems are likely to occur due to, web 74 hanging up on the nozzles 10 when a break in the web 74 occurs in the dryer unit. Furthermore, replacement, maintenance or adjustment of the nozzles 10 can be accomplished without having to enter the dryer unit 76.

The nozzle arrays 78 are preferably mounted on retractable/adjustable support units illustrated diagrammatically at 80 so that the nozzles can be retracted away from the web 74 automatically when a web break occurs. The retractable nozzle arrays 78 also provide for easier maintenance and movement of the nozzles toward and away from web 74 as indicated by arrows 82. Units 80 preferably also provide a plenum or manifold function for directing gas and liquid delivered into units 80 as by conduits 84 and conduits 86, respectively, wherein individual flows of gas and liquid may be directed to the separate nozzles 10, or the gas and liquid pre-mixed in units 80 or even prior to delivery to units for being directed onto the web 74 as moistened gas in the aforedescribed manner. Suitable fans or pumps are employed as necessary to develop the pressure required for the desired flow velocities and flow patterns of moisturized gas from nozzles 10 onto web 74.

From nozzle arrays 78, the web 74 may be further treated in a steaming unit 88 containing a plurality of steam nozzles 90 wherein steam is applied to the web to increase its moisture content to desired degree which may be an increase of from about 0.3 to at least about 2% by weight over and above that of web proceeding from nozzle arrays 78 to a final moisture content of from about 1.5 to about 8% by weight. It will be understood that multiple steam nozzles 90 in multiple rows along the machine direction may be used to effectively rewet the web 74, however, for simplicity, only a single steam nozzle 90 is shown.

After the steaming unit 88, web 74 is preferably then processed through one or more calender units 92 for enhancement of the web surface smoothness and caliper uniformity and other purposes. Typically, one or more rolls in the calendering unit 92 are heated and are arranged relative to one another to nip the product proceeding there-through at pressures ranging from about 100 to about 1500 pli, although the pressure can vary outside these limits depending on the product being processed and the effect to be produced on the web. The web 74 emerging from calendering unit 92 typically has a moisture content below about 7 wt. % and a substantially uniform thickness and smoothness across its width.

It will be appreciated that in contrast with conventional practice, use of arrays 78 of radial jet reattachment nozzles 10 according to the invention effectively conditions the web 74 by cooling the web with moist gas resulting in more effective rewetting of the web with steam in the steaming unit 88. Because the nozzles 10 provide relatively uniform conditioning of the web prior to rewetting the web with steam, the efficiency of web calendering is also improved without adversely affecting other properties of the web such as strength, dimensional stability, streaking, shrinkage in the cross machine direction and the like.

As an exemplary embodiment involving the production of 180 lb/3000 $ft^2$ basis weight paper having a width 72 of 100 inches at a machine speed of about 800 ft/min., a nozzle array believed to be effective for conditioning the web prior to calendering includes 100 nozzles arranged in four staggered rows (see FIG. 6) with 25 nozzles per row across the width of the web. Adjacent nozzles are preferably uniformly spaced a distance of 4 inches measured from the centers of the adjacent nozzles. The ends of the nozzles are preferably spaced from about 0.5 to about 2 inches away from the surface of the web, which spacing is adjustable to achieve optimum effect.

Gas delivered to the nozzles is air and liquid delivered to nozzles is water and the gas is moistened by atomized water droplets to an absolute humidity of at least about 0.01 at a temperature of about 32° C. In this exemplary arrangement, moistened gas is emitted from the nozzles at flow velocities in the range of from about 100 to about 300 feet per second. The amount of moisture contained in the moistened gas is dependent on the particular cooling and moisturizing requirements of the web. A typical amount of water applied to a moving web ranges from about 0.05 to about 1.0 pounds per minute per foot width of the web.

In one of many variations in the operational sequence illustrated in FIG. 7, there may be employed a step of rewetting the web in the dryer unit 76 as described in U.S. Pat. No. 5,470,436 to Wagle et al. incorporated herein by reference as if fully set forth, which enables increased heat transfer to the interior of the web. Combined with web conditioning according to the invention, significantly improved drying rates may be achieved by employing the rewetting concept of the '436 patent with improved calendering performance and improved web properties and uniformity. The moisture profile of a web may also be improved by selectively applying moisture to dry areas of the web.

Figure 8:
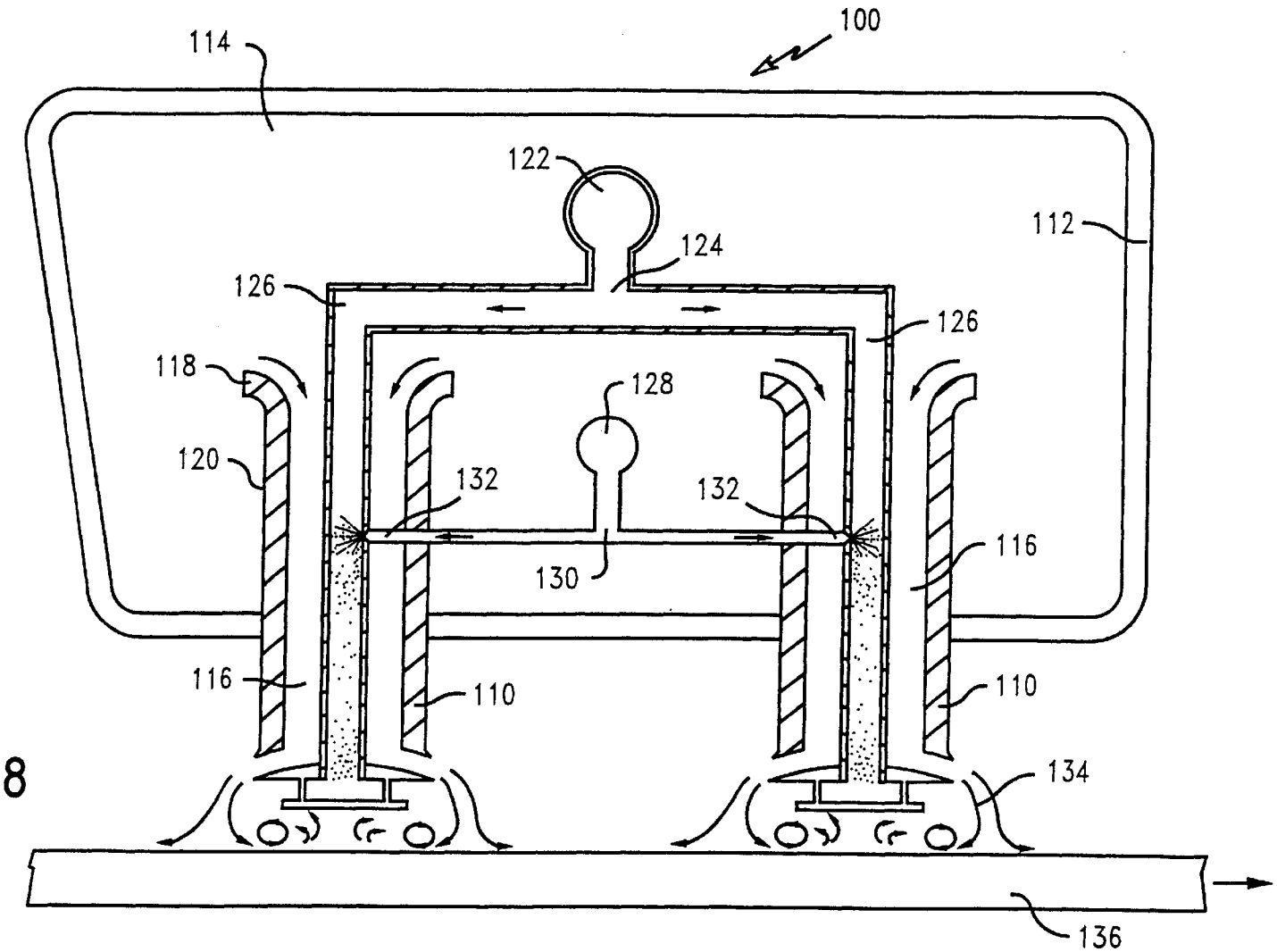
FIG. 8 is a diagrammatic end view of a plenum arrangement useful for providing pressurized gas to a plurality of radial jet reattachment nozzles.

FIG. 8 illustrates an end view of one embodiment of a plenum 100 for providing a pressurized gas to an array of radial jet reattachment nozzles 110. Plenum walls 112, as seen from the end view of the plenum, define a substantially sealed plenum chamber 114. Pressurized gas from a gas source is caused to flow into the plenum chamber 114 from an end thereof (the gas inlet connection and gas source not being shown), which chamber 114 is in flow communication with annular flow space 116 of nozzles 110. The upper ends 118 of sleeves 120 of nozzles 110 may be straight or may be flared for greater air flow and/or less pressure drop adjacent the entrance thereof. In the embodiment of FIG. 8, reattachment nozzles 110 correspond substantially to nozzle 10' described with reference to FIG. 2 in configuration and operation. Accordingly, additional pressurized gas is introduced by means of inlet 122 (as seen from an end view of an inlet conduit, not shown) and distributor 124 into conduits or tubes 126 of nozzles 110.

Pressurized liquid is delivered from inlet 128 (as seen from an end view of an inlet conduit, not shown) and distributor 130 to liquid ejectors 132 for introducing a spray or mist of liquid into the interior of tubes 126 in order to provide a moisturized gas 134 for impact on a moving web 136 as described with reference to FIG. 2.

The pressurized gas inlet 122 and pressurized liquid inlet 128 and associated conduits (not shown) are preferably independently supported for movement of either the tubes 126 or entire plenum 100 toward or away from the web. Accordingly, sleeves 120 may be slotted for movement thereof relative to the liquid ejectors 132 without the need for elaborate sealing methods because the interior of sleeves 120 and the exterior of sleeves 120 adjacent the liquid ejectors 132 are wholly within the plenum chamber 114.

It will be understood that plenum 100 is merely one preferred structural arrangement for use in delivering gas and liquid to nozzles 110, and that other suitable structural plenum arrangements may be devised to suit particular circumstances. Also, other nozzle designs such as those of FIG. 1, FIG. 3 and FIGS. 4–5 as well as variations and modifications of any of the foregoing within the scope of the invention as claimed may be used with any plenum configuration such as the plenum 100 by suitable adaptations devisable by those of ordinary skill.

Furthermore, while the foregoing apparatus and process has been described with reference to a papermaking process, it will be recognized that the apparatus and method may be applied to any continuous web handling equipment such as converting equipment where there is a need to moisturize and/or cool a moving web. Furthermore, the invention is not limited to cellulosic webs and may be applied to other continuous moving webs made of natural and synthetic materials amenable to treatment for the effect enabled by the present invention.

Having now fully described the invention and various known embodiments thereof, it will be recognized by those of ordinary skill that the invention is capable of numerous modifications, rearrangements and substitutions without departing from the spirit and scope of the invention as defined by the appended claims.

What is claimed is:

1. An apparatus for conditioning an elongate moving web comprising means for producing a moisturized gas having an absolute humidity of about 0.01 or greater and including air containing a mist of water droplets and an array of radial jet reattachment nozzles for applying a flow of the moisturized gas as a mixture of air with a mist of water droplets entrained therein onto a surface of the moving web sufficient to create a combination of both suction and pressure forces on the same surface of the web such that the web is urged toward the nozzles while providing a cushion of air between the nozzles and the web to thereby limit contact between the nozzles and the web and cause water droplets in the gas to contact the web and be absorbed by the surface thereof wherein said nozzles are arranged across the width and along at least a portion of the length of the web, each nozzle having an elongate cylindrical sleeve with a gas inlet and a circular open end adjacent the web opposite the inlet, a flow director at lease partially disposed within the cylindrical sleeve comprising a head spaced outwardly from the open end of the sleeve toward the web and a rod axially aligned within the elongate sleeve so as to provide an annular flow space between the sleeve and the rod, said rod having an interior opening along at least a portion of its length in flow communication with a source of liquid and includes means for emitting liquid from said interior opening out into said annular flow space, the head being connected to one end of the rod, so that moistured gas flows through said annular space out said open end of said sleeve between said open end and said head and then onto the surface of the web.

2. The apparatus of claim 1 wherein said means for emitting comprises slots or perforations in said tube providing flow communication between said interior opening and said annular flow space.

3. The apparatus of claim 1 wherein said head comprises a circular disc having a dome-shaped surface adjacent said open end of said sleeve which surface is spaced from said open end of said sleeve from about 2 to about 7 millimeters.

4. The apparatus of claim 1 wherein said rod includes a distal open end adjacent said head in flow communication with said interior opening, and the flow director further comprises a deflector supported adjacent said head so as to face said distal open end of said rod in spaced relation with said head, said distal open end comprising an orifice configured to emit a liquid stream therefrom in the direction of said deflector.

5. The apparatus of claim 4, wherein at least a portion of said deflector is provided by a cone or pyramidal-shaped protrusion whose apex is adjacent said orifice so that liquid emitted from said orifice is caused to flow radially outwardly relative to the axis of said rod by reason of contact of the liquid stream with said protrusion.

6. An apparatus for conditioning an elongate moving web comprising means for producing a moisturized gas having an absolute humidity of about 0.01 or greater and including air containing a mist of water droplets and an array of radial jet reattachment nozzles for applying a flow of the moisturized gas as a mixture of air with a mist of water droplets entrained therein onto a surface of the moving web sufficient to create a combination of both suction and pressure forces on the same surface of the web such that the web is urged toward the nozzles while providing a cushion of air between the nozzles and the web to thereby limit contact between the nozzles and the web and cause water droplets in the gas to contact the web and be absorbed by the surface thereof wherein said nozzles are arranged across the width and along at least a portion of the length of the web, each nozzle having an elongate cylindrical sleeve with a gas inlet and a circular open end adjacent the web opposite the inlet, a flow director at lease partially disposed within the cylindrical sleeve comprising a head spaced outwardly from the open end of the sleeve toward the web and a rod axially aligned within the elongate sleeve so as to provide annular flow space between the sleeve and the rod, the head being connected to one end of the rod, wherein moisturized gas flows through said annular space out said open end of said sleeve between said open end and said head and then onto the surface of the web wherein said rod contains an interior opening in flow communication with a source of moisturized gas and a distal open end adjacent said head in flow communication with said interior opening, and the flow director further comprises a deflector supported adjacent said head so as to face said distal open end of said rod in spaced relation with said head, said distal one end comprising an orifice configured to emit moisturized gas therefrom in the direction of said deflector and wherein at least a portion of said deflector is provided by a cone or pyramidal-shaped protrusion whose apex is adjacent said orifice so that moistened gas emitted from said orifice is caused to flow radially outwardly relative to the axis of said rod by reason of contact of the gas with said protrusion.

* * * * *